US008613152B2

(12) United States Patent
Suciu et al.

(10) Patent No.: US 8,613,152 B2
(45) Date of Patent: Dec. 24, 2013

(54) GRAPHIC DISPLAY CAPTURE-ARRANGEMENT FOR A MOLDED CONTOUR STAND

(75) Inventors: Rebecca C. Suciu, Lynn, MA (US); Thomas P. Burrous, Haverhill, MA (US); David E. Pitcher, Swampscott, MA (US); Alan L. Stenfors, Scituate, MA (US); Sidney Rose, Marblehead, MA (US)

(73) Assignee: Rose Displays, Ltd., Salem, MA (US)

( * ) Notice: Subject to any disclaimer, the term of this patent is extended or adjusted under 35 U.S.C. 154(b) by 49 days.

(21) Appl. No.: 13/199,448

(22) Filed: Aug. 30, 2011

(65) Prior Publication Data

US 2012/0186120 A1 Jul. 26, 2012

Related U.S. Application Data

(63) Continuation-in-part of application No. 12/931,045, filed on Jan. 21, 2011.

(51) Int. Cl.
*G09F 15/00* (2006.01)

(52) U.S. Cl.
USPC ..... 40/606.12; 40/606.18

(58) Field of Classification Search
USPC ..... 40/606.12, 606.18, 611.05, 611.06, 40/734, 738, 766; 160/10, 352
See application file for complete search history.

(56) References Cited

U.S. PATENT DOCUMENTS

| | | | | |
|---|---|---|---|---|
| 5,038,935 | A * | 8/1991 | Wenkman et al. | 206/455 |
| 5,617,660 | A * | 4/1997 | Pollack | 40/606.17 |
| 7,562,849 | B2 * | 7/2009 | Pitcher et al. | 248/158 |
| 2006/0086025 | A1 * | 4/2006 | Benedict et al. | 40/606.12 |
| 2009/0056185 | A1 * | 3/2009 | Wamsley | 40/611.12 |

* cited by examiner

*Primary Examiner* — Joanne Silbermann
(74) *Attorney, Agent, or Firm* — Don Halgren

(57) ABSTRACT

A graphic display system for supporting at least one graphic display panel in a curvilinear presentation, the system comprising: a lower plate and an upper plate arranged parallel and spaced apart with respect to one another, each plate having a corner arranged thereon, wherein the lower plate has an arcuately shaped peripheral lip to define an inwardly adjacent backer board receiving channel thereadjacent, including an elongated side rail arranged between the first plate and the second plate at their respective corners, wherein each elongated side rail has an engagement and alignment flange received into a receiving slot in both the first plate and the second plate.

13 Claims, 6 Drawing Sheets

GRAPHIC DISPLAY CAPTURE-ARRANGEMENT FOR A MOLDED CONTOUR STAND

This invention relates to graphic display arrangements comprising a free standing graphic display having a curved configuration, and more particularly, a graphic display capture arrangement which provides secure alignment of a graphic within a contoured stand, and is a continuation-in-part application of our U.S. patent application Ser. No. 12/931,045 filed Jan. 21, 2011, which is incorporated herein by reference in its entirety, and is an improvement of our commonly assigned U.S. Pat. No. 7,562,849, which is also incorporated herein by reference in its entirety.

BACKGROUND OF THE INVENTION

Field of the Invention

Prior Art Discussion

Curved stand point of sale displays are an attractive way to get customers attention. These displays are changed on a regular basis in as much as the products change and their closeness to customers necessitates the need to be substantial and robust in appearance and easily set up. This invention comprises an improvement over the above mentioned '849 patent providing a more stable environment for a graphic display.

It is an object of the present invention to improve upon the curved stand displays of the prior art.

It is a yet further object of the present invention to more securely grasp formable/bendable/curved graphic display panels at their side edges.

BRIEF SUMMARY OF THE INVENTION

The present invention comprises a stand assembly for securely supporting one or more large, flexible display panels in an attractive, simply supported and robustly appearing manner. The present stand arrangement in a first embodiment thereof comprises a lower shelf and an upper cap or shelf, spaced apart and parallel to one another. In a first preferred embodiment, the lower shelf and the upper shelf are juxtaposed in a vertical configuration. Each shelf has a plurality of corners at which a support arrangement is disposed. Each support arrangement is comprised of a side rail.

In one preferred embodiment of the curved stand arrangement, the lower shelf and the cap or upper shelf may be somewhat elongated in a configuration such as for example, an elongated oval shape. Other shapes of the particular shelf members may be similar to that shown in the '849 patent, incorporated herein by reference.

In a further preferred form of the present invention, a central support post may be disposed between the lower shelf and the upper shelf. There may also be a second post extending to a base, from the lower shelf, so as to support the curved display off of the floor. The dimensions between any adjacent side rails are preferably shorter than the width or side support dimensions of any particular display panel supported therebetween. That dimensional limitation permits the desired curved configuration to that display panel being supported between the side rail arrangements, whether those display panels are displayed in a convex or concave manner.

Each elongated side rail is attached at their respective ends to the lower plate and the upper plate. Each side rail is of generally "V" (or "U") shape in transverse cross-section across its (elongated) longitudinal axis. Each side rail has an elongated longitudinally extending first side rail arm (edge) and a second side rail arm (edge). The first side rail arm and the second side rail arm are connected to one another by a longitudinally extending arcuate web. An elongated longitudinally extending inner side rail pressure leg extends from the longitudinally extending arcuate web adjacent the juncture of that arcuate web with each of the respective side rail arms to form a bifurcation. The respective inner side rail pressure legs and the first and the second side (outer) rail arms are generally parallel to one another and define between them an elongated receiving channel for receiving the side edges of a graphic display supporting backer board.

The inner side rail pressure legs are of arcuate shape, each having a distalmost edge which provides a bias against the back side of a backer board whose edge(s) is (are) received within their respective elongated receiving channel. An elongated side rail finger extends from the inner side of the side rail arms and into the elongated receiving channel. The elongated side rail finger functions as a pressure mechanism against the side edges of a backer board received thereadjacent, and also functions as an elongated "edge-stop" for the side edges of a graphic panel also placed within the elongated receiving channels and against the backer board.

An elongated T-shaped flange extends radially outwardly from a midpoint of the arcuate web, which web connects the first and second side rail arms. The upper plate and the lower plate each have a pattern of ribs arranged on their respective inwardly facing surfaces thereof. The pattern of ribs at each respective end of both the upper plate and the lower plate includes a T-shaped slot arranged to receive the respective ends of the elongated T-shaped flange which extends off of the arcuate web between the first side rail arm and the second side rail arm. A center pole may extend within the curved display panel arrangement between the lower shelf and the upper shelf, so as to provide for structure and stability thereof, in addition to those respective side rails extending between the lower shelf and the upper shelf.

The lower plate has a center pole-capture-chamber arranged at its midpoint. The lower plate also has a peripheral lip extending upwardly. A peripheral channel adjacent that lip defines an arcuate recess for receiving the lower edge of a backer board for that display arrangement. The arcuately shaped peripheral lip has a flat upper edge which defines a support surface on which a graphic display may rest. The lower plate also has a finger hole arranged at a midpoint thereof internally adjacent the peripheral lip on each side of the lower plate. The finger hole through the respective sides of the lower plate facilitates easy changing of a graphic display on the curved stand display arrangement.

Thus what has been shown is a simpler graphic display support arrangement for ease of assembly and ease of graphic panel display changing.

The invention thus comprises a graphic display system for supporting at least one graphic display panel in a curvilinear presentation, the system comprising: a lower plate and an upper plate arranged parallel and spaced apart with respect to one another, each plate having at least one corner arranged thereon, wherein the lower plate has an arcuately shaped peripheral lip to define an inwardly adjacent backer board receiving trough or channel thereadjacent; an elongated side rail arranged between the first plate and the second plate at their respective corners, wherein each elongated side rail has an engagement and alignment flange received into a receiving slot in both the first plate and the second plate. Each elongated side rail preferably includes a first side rail arm and a second side rail arm, and wherein each side rail arm has a bifurcated distalmost elongated edge, and wherein each bifurcated distalmost elongated edge defines a backer board receiving channel. Each bifurcated distalmost elongated edge includes an inner arcuately shaped side rail pressure leg. The backer board receiving channel has a side rail spacer finger extending therewithin to function as a securement means for a backer board or panel and has an edge stop for a display panel. The lower plate includes a finger hole extending therethrough on each lateral side of the lower plate, so as to permit ease of changing a graphic display panel thereby. Each elongated side rail is of generally "V" (or "U") shape in cross-section. The alignment and engagement flange extends off of a connecting web arranged between the first side rail arm and the second side rail arm. The connecting web is preferably of arcuate shape in cross-section.

The invention also comprises a method of supporting a plurality of flexible curved display panels, comprising one or more of the steps comprising: securing a plurality of peripherally curved shelves together in shape-corresponding alignment with a pair of parallel, transversely adjacent side rails fastened between respective corners of the spaced part shelves; forming an elongated bifurcated edge on each side of the side rails so as to form a backer board receiving channel therein; and forming one side of the bifurcated edge on each side of the side rails so as to bias against an inside edge surface of a backer board placed therewithin, and forming an inwardly directed lip on the lateral side of each respective shelf so as to form a backer board receiving trough therein.

The invention also comprises a graphic display system for supporting at least one graphic display panel in a curvilinear presentation, the system comprising: a lower plate and an upper plate arranged parallel and spaced vertically apart with respect to one another, each plate having at least one corner arranged thereon, wherein at least the lower plate has an arcuately shaped peripheral lip to define an adjacent, inwardly facing backer board receiving channel thereadjacent; an elongated side rail arranged between the first plate and the second plate between their respective corners, wherein each elongated side rail is of generally "V" shape in cross-section, and has an elongated, bifurcated backer-board receiving slot on each side thereof; and wherein the receiving slot is defined by an elongated, curved innermost leg, which leg is biased against any backer board received within the receiving slot. The backer board receiving slot is also defined on the opposite side of the slot by an elongated side rail arm. The curved innermost leg is biased against the rear side of any backer board received in the. slot. The curved innermost leg on each side of the elongated "V" shaped side rail are connected to one another by a web of arcuate shape in cross-section. The elongated arcuate web has an elongated flange extending radially outwardly therefrom. The flange is preferably of "T" shape in cross-section. The "T" shaped flange has an upper end and a lower end which engage with a set of ribbed defined slots in the upper plate and the lower plate respectively, for securement purposed therewith.

BRIEF DESCRIPTION OF THE DRAWINGS

The objects and advantages of the present invention will become more apparent, when viewed in conjunction with the following drawings in which.

DETAILED DESCRIPTION OF THE PRESENT INVENTION

Figure 1:
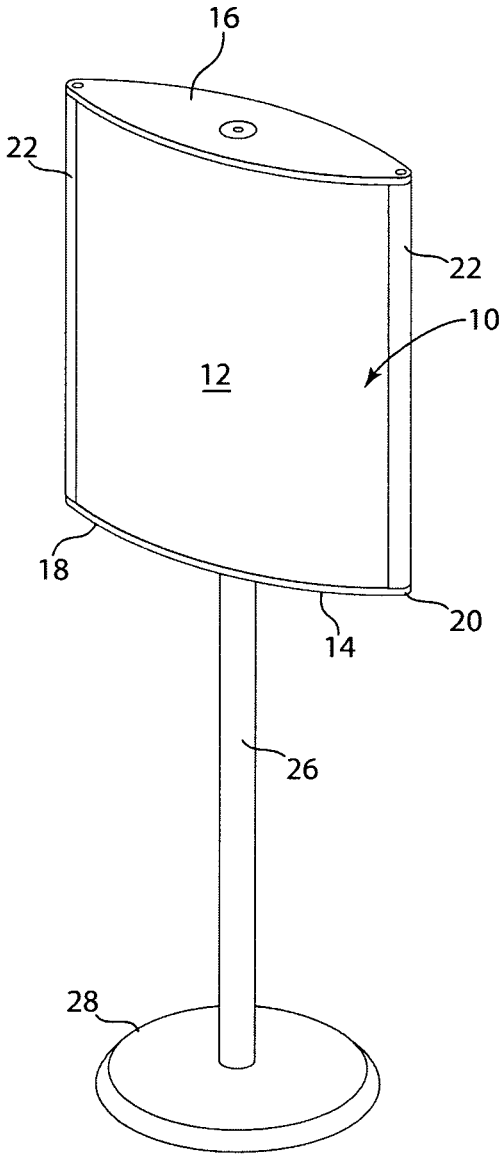
FIG. 1 is a perspective view of a curved stand arrangement constructed according to the principles of the present invention.
Figure 2:
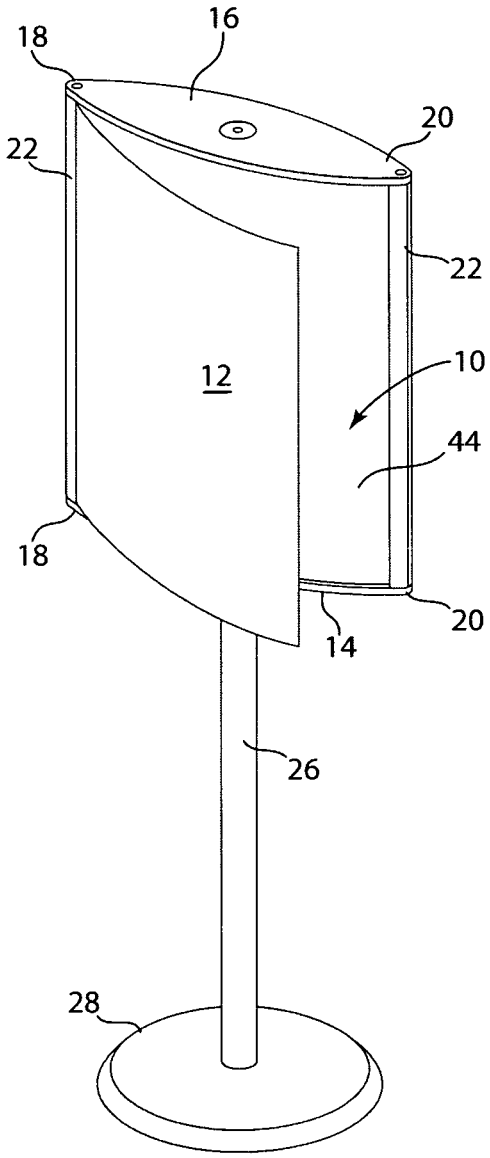
FIG. 2 is a view similar to FIG. 1, showing a graphic display angled away from a backer board supported therewithin.

Referring now to the drawings in detail and particularly to FIGS. 1 and 2 there is shown of the present invention which comprises a molded contour stand assembly 10 for securely supporting one or more large, flexible display panels 12 in an attractive, simply supported and robustly appearing manner. The present stand arrangement 10 in a first embodiment thereof comprises a lower shelf 14 and an upper cap or shelf 16, spaced apart and parallel to one another, as may be seen in FIG. 3. In a first preferred embodiment, the lower shelf 14 and the upper shelf 16 are juxtaposed in a vertical configuration. Each shelf 14 and 16 preferably has a plurality of corners 18 and 20, at which an elongated side rail support arrangement 22 is disposed.

Figure 3:
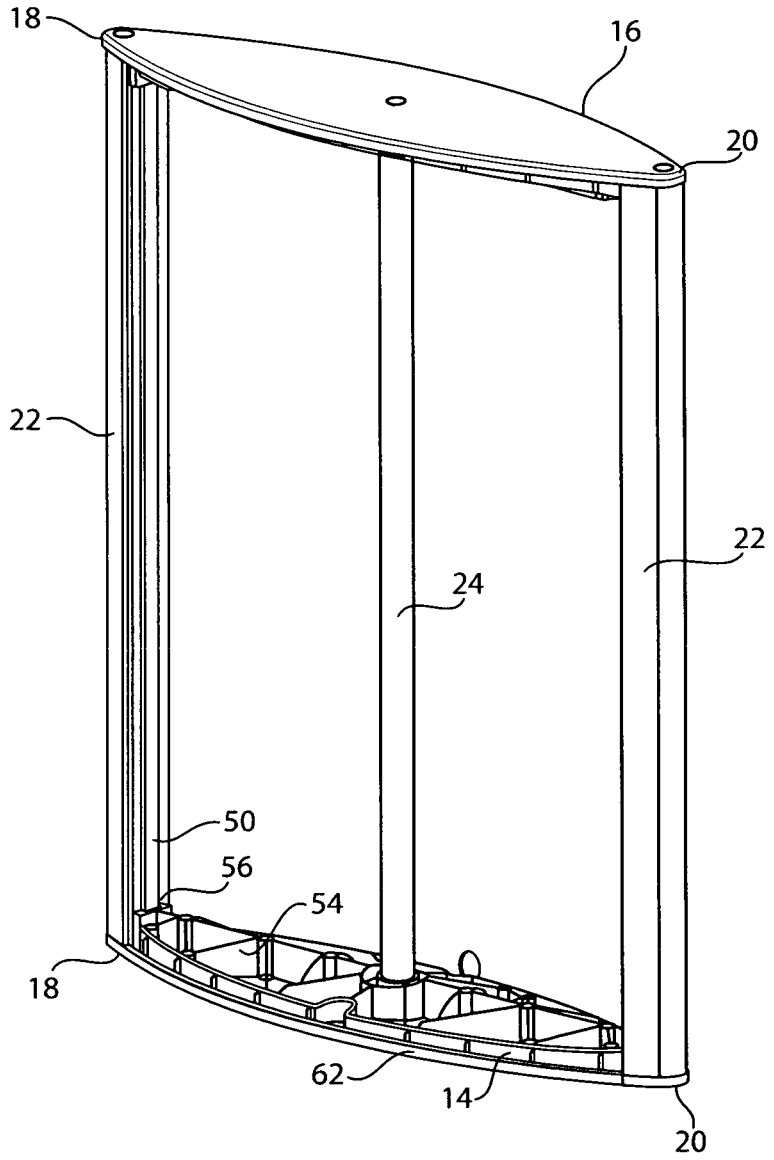
FIG. 3 is a perspective view of the central housing of the curved stand arrangement.
Figure 7:
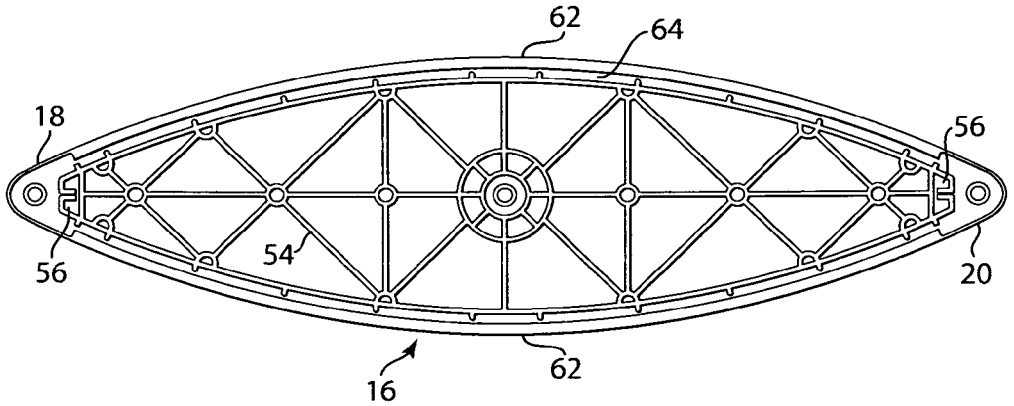
FIG. 7 is a view of the inside surface of the upper plate.
Figure 8:
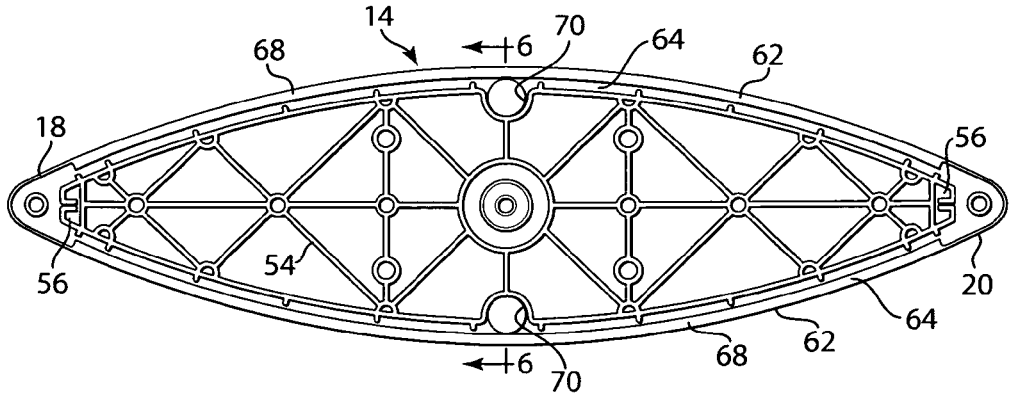
FIG. 8 is a plan view of the lower plate.

In one preferred embodiment of the curved stand arrangement 10, the lower shelf 14 and the cap or upper shelf 16 may be somewhat elongated in a configuration such as for example, an elongated oval shape, as is shown best in FIGS. 3, 7 and 8. Other embodiments and aspects of the present invention may include shapes of the particular shelf members which may be similar to that shown in the '849 patent, incorporated herein by reference.

In a further preferred form of the present invention, a central support post 24 may be disposed between the lower shelf 14 and the upper shelf 16, as represented in FIG. 3. There may also be a second pole 26 extending to a base 28, as represented in FIGS. 1 and 2, so as to support the curved display housing off of the floor. The horizontal dimension between the side rails 22 at the ends of the shelves 14 and 16 is preferably shorter than the width or side wise dimensions of any particular display panel 12 supported therebetween. That dimensional limitation permits the desired curved configuration to that graphic display panel 12 being supported between the side rail arrangements 22, whether those display panels 12 are displayed in a convex or concave manner.

Figure 4:
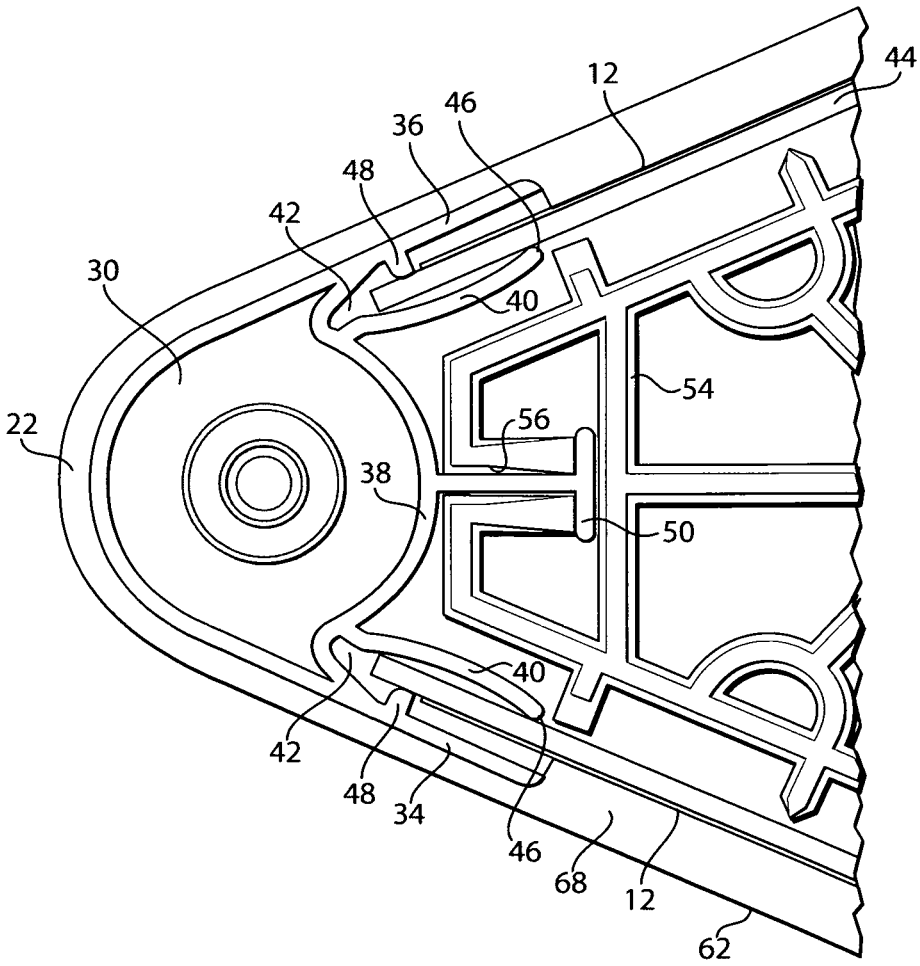
FIG. 4 is a plan view of one and of the curved stand arrangement looking downwardly at a side rail supported on the lower plate.
Figure 5:
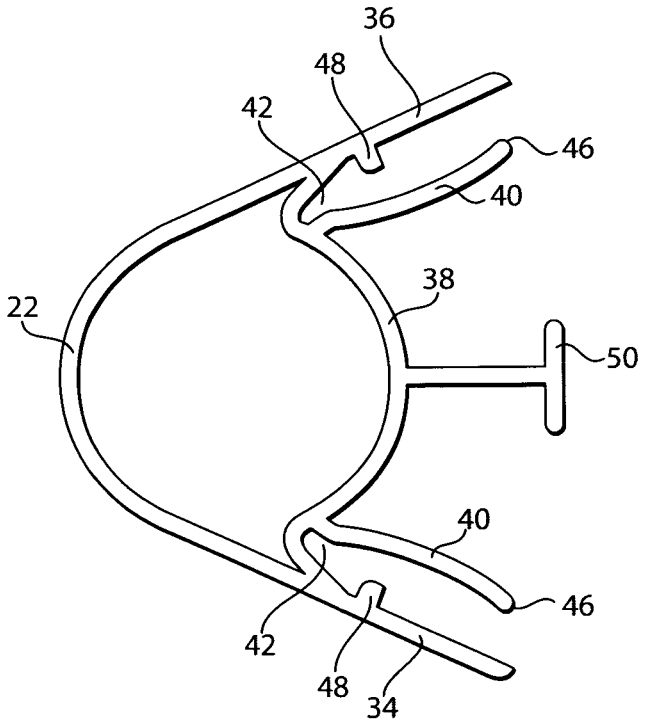
FIG. 5 is an end view of the side rail shown in FIG. 4.

Each elongated side rail 22 is attached at their respective ends to the lower plate 14 and the upper plate 16. Each side rail 22 is of generally "V" (or "U") shape 30 in a transverse cross-section, as is represented in FIG. 4. Each side rail 22 has an elongated longitudinally extending first side rail arm 34 and a second side rail arm 36. The first side rail arm 34 and the second side rail arm 36 are connected to one another by a longitudinally extending arcuate web 38, as shown in FIGS. 4 and 5. An elongated longitudinally extending inner side rail pressure leg 40 extends from the longitudinally extending arcuate web 38 adjacent the juncture of that arcuate web 38 with each of the respective side rail arms 34 and 36. The respective inner side rail pressure legs 40 and the first and the second side rail arms 34 and 36 are generally parallel to one another and bifurcatedly define between them an elongated receiving channel 42 for receiving the side edges of a graphic-display-supporting backer board 44, as represented in FIG. 4.

The inner side rail pressure legs 40 are of arcuate shape, each having an elongated distalmost edge 46 which provides a bias against the back side of a backer board 44 whose edge(s) is (are) received within the elongated receiving channel 42, as best represented in FIG. 4. An elongated side rail finger 48 extends from the inner side of the side rail arms 34 and 36, and into the respective elongated receiving channels 42. Each elongated side rail finger 48 functions as a pressure mechanism against the front surface of a backer board 44 received thereadjacent, and also functions as an elongated "edge-stop" for the side edges of a graphic panel 12 also placed within the elongated receiving channels 42 and against the backer board 44, as represented in FIG. 4.

An elongated T-shaped alignment and engagement flange 50 extends radially outwardly from a midpoint of the arcuate web 38, which web 38 connects the first and second side rail arms 34 and 36, as shown in FIGS. 4 and 5. The upper plate 16 and the lower plate 14 each have a pattern of ribs 54 arranged on their respective inwardly facing (one another) surfaces thereof, as variously represented in FIGS. 3, 4, 6, 7 and 8. The pattern of ribs 54 at each respective end of both the upper plate 16 and the lower plate 14 includes a T-shaped flange-receiving slot 56 arranged to receive the respective ends of the elongated T-shaped flange 50, (shown best in FIG. 4) which T-shaped flange 50 extends off of the arcuate web 38 between the first side rail arm 34 and the second side rail arm 36. A center pole 24 may fixedly extend within the curved display panel arrangement 10 between the lower shelf 14 and the upper shelf 16, as represented in FIGS. 2 and 3, so as to provide for structure and stability thereof, in addition to those respective side rails 22 extending between the lower shelf 14 and the upper shelf 16.

Figure 6:
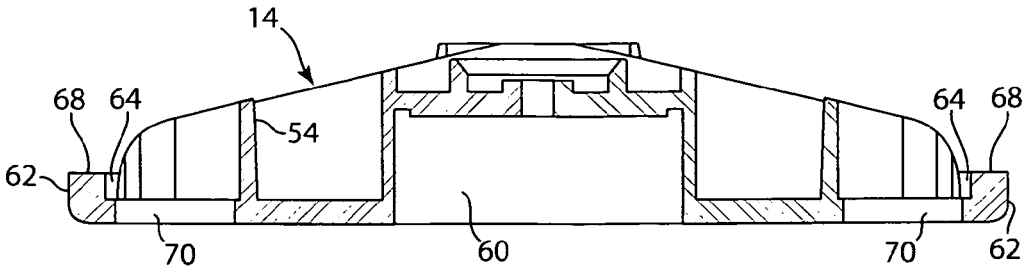
FIG. 6 is a sectional view taken across the longitudinal axis of the lower plate.

The lower plate 14, a shown in FIG. 6, has a center pole capture-chamber 60 arranged at its midpoint. The lower plate 14 and the upper plate 16 each have a peripheral lip 62 extending upwardly, along its lateral or side edges, as represented in FIGS. 6, 7 and 8. A lengthwise extending peripheral channel 64 inwardly adjacent that lip 62 defines an arcuate recess or trough 64 for securely receiving respectively, the lower edge (and the upper edge) of a backer board 44 for that display arrangement. The arcuately shaped peripheral lip 62 on the lower plate 14 has an upper edge surface 68, best shown in FIG. 6, which defines a support surface on which a graphic display 12 may rest when placed against the backer board 44. The lower plate 14 also has a finger hole 70, arranged at a midpoint thereof internally adjacent the peripheral lip 62 on each side of the lower plate 14, as represented in FIGS. 6 and 8. The finger hole 70 through the respective lateral sides of the lower plate 14 facilitates easy changing of a graphic display 12 on the curved stand display arrangement 10.

The invention claimed is:

1. A graphic display system for supporting at least one graphic display panel in a curvilinear presentation, the system comprising:

a lower plate and an upper plate arranged parallel and spaced apart with respect to one another, each plate having a corner arranged thereon, wherein the lower plate has an arcuately shaped curvilinear-graphic-display-panel-support-enabling peripheral lip which defines an adjacent, lower, inwardly facing backer board receiving channel inwardly adjacent that peripheral lip;

an elongated side rail arranged between the first plate and the second plate at their respective corners, wherein each elongated side rail has an engagement and alignment flange received into a receiving slot in both the first plate and the second plate; and wherein each elongated side rail includes a first side rail arm and a second side rail arm, and wherein each side rail arm has an inner side rail pressure leg thereadjacent wherein a vertically arranged backer board receiving channel is disposed between them.

2. The graphic display system as recited in claim 1, wherein each side rail pressure leg is of arcuate shape.

3. The graphic display system as recited in claim 1, wherein the backer board receiving channel has a side rail spacer finger extending therewithin to function as a securement means for a backer panel and as an edge stop for a display panel.

4. The graphic display system as recited in claim 1, wherein the lower plate has a finger hole extending therethrough on each lateral side of the lower plate, so as to permit ease of manually changing a graphic display panel thereby.

5. The graphic display system as recited in claim 1, wherein each elongated side rail is of generally "V" shape in cross section.

6. The graphic display system as recited in claim 1, wherein the alignment and engagement flange extends off of a connecting web arranged between the first side rail arm and the second side rail arm.

7. The graphic display system as recited in claim 6, wherein the connecting web is of arcuate shaped in cross-section.

8. A graphic display system for supporting at least one graphic display panel in a curvilinear presentation, the system comprising:

a lower plate and an upper plate arranged parallel and spaced vertically apart with respect to one another, each plate having at least one corner arranged thereon, wherein at least the lower plate has an arcuately shaped non-linear peripheral lip to define an adjacent, inwardly facing, horizontally oriented nonlinear backer board receiving channel and a non-linear graphic display panel receiving channel perpendicularly thereadjacent to enable receipt and support of a curvilinear backer board and a curvilinear graphic display panel;

an elongated side rail arranged between the first plate and the second plate between their respective corners, wherein each elongated side rail is of generally "V" shape in cross-section, and has an elongated, bifurcated vertically oriented backerboard receiving slot on each side thereof; and wherein the receiving slot is defined by an elongated, curved innermost leg, which is biased against any backer board received within the receiving slot; and wherein the curved innermost leg is biased against the rear side of any backer board received in the slot, and wherein the curved innermost leg on each side of the elongated "V" shaped side rail are connected to one another by a web of arcuate shape in cross-section and wherein the backer board receiving slot is also defined on the opposite side of the slot by an elongated side rail arm.

9. A graphic display system for supporting at least one graphic display panel in a curvilinear presentation, the system comprising:

a lower plate and an upper plate arranged parallel and spaced vertically apart with respect to one another, each plate having at least one corner arranged thereon, wherein at least the lower plate has an arcuately shaped non-linear peripheral lip to define an adjacent, inwardly facing, horizontally oriented non-linear backer board receiving channel and a nonlinear graphic display panel receiving channel perpendicularly thereadjacent to enable receipt and support of a curvilinear backer board and a curvilinear graphic display panel;

an elongated side rail arranged between the first plate and the second plate between their respective corners, wherein each elongated side rail is of generally "V" shape in cross-section, and has an elongated, bifurcated vertically oriented backer-board receiving slot on each side thereof; and wherein the receiving slot is defined by an elongated, curved innermost leg, which is biased against any backer board received within the receiving slot; and wherein the curved innermost leg is biased against the rear side of any backer board received in the slot, and wherein the curved innermost leg on each side of the elongated "V" shaped side rail are connected to one another by a web of arcuate shape in cross-section.

10. The graphic display system as recited in claim 9, wherein the backer board receiving slot is also defined on the opposite side of the slot by an elongated side rail arm.

11. The graphic display system as recited in claim 9, wherein the elongated arcuate web has an elongated engagement and alignment flange extending radially outwardly therefrom.

12. The graphic display system as recited in claim 11, wherein the engagement and alignment flange is of "T" shape in cross-section.

13. The graphic display system as recited in claim 12, wherein the "T" shaped engagement and alignment flange has an upper end and a lower end which engage with a set of slots in the upper plate and the lower plate respectively, for securement purposes therewith.

* * * * *